US008662887B2

(12) United States Patent
Cain et al.

(10) Patent No.: US 8,662,887 B2
(45) Date of Patent: Mar. 4, 2014

(54) NOX SUPPRESSION TECHNIQUES FOR A ROTARY KILN

(75) Inventors: Bruce E. Cain, Akron, OH (US); Thomas F. Robertson, Medina Township, OH (US); John J. Nowakowski, Valley View, OH (US)

(73) Assignee: Fives North American Combustion, Inc., Cleveland, OH (US)

( * ) Notice: Subject to any disclaimer, the term of this patent is extended or adjusted under 35 U.S.C. 154(b) by 1143 days.

(21) Appl. No.: 12/552,518

(22) Filed: Sep. 2, 2009

(65) Prior Publication Data

US 2010/0248175 A1 Sep. 30, 2010

Related U.S. Application Data

(60) Provisional application No. 61/180,235, filed on May 21, 2009, provisional application No. 61/162,853, filed on Mar. 24, 2009.

(51) Int. Cl.
*F27B 7/32* (2006.01)

(52) U.S. Cl.
USPC ..... 432/117; 432/103; 431/354

(58) Field of Classification Search
USPC ..... 432/72, 103, 106, 117; 431/354; 60/775, 776, 777
See application file for complete search history.

(56) References Cited

U.S. PATENT DOCUMENTS

| | | | | |
|---|---|---|---|---|
| 3,947,001 A | | 3/1976 | Leighton | |
| 4,066,470 A | | 1/1978 | Brachthauser et al. | |
| 4,313,757 A | | 2/1982 | Kiyonoga | |
| 4,475,466 A | * | 10/1984 | Gravely | 588/321 |
| 4,503,018 A | | 3/1985 | Gardner et al. | |
| 4,689,007 A | | 8/1987 | Kilian | |
| 4,863,371 A | | 9/1989 | Ho | |
| 5,201,650 A | | 4/1993 | Johnson | |
| 5,299,512 A | | 4/1994 | Olsen | |
| 5,630,864 A | | 5/1997 | Rierson | |
| 5,667,376 A | * | 9/1997 | Robertson et al. | 431/115 |
| 5,730,591 A | * | 3/1998 | Robertson et al. | 432/106 |
| 6,089,170 A | | 7/2000 | Conti et al. | |
| 6,116,896 A | | 9/2000 | Joshi et al. | |
| 6,221,127 B1 | | 4/2001 | Rierson | |
| 6,347,937 B1 | * | 2/2002 | Yearham et al. | 432/114 |
| 6,773,256 B2 | * | 8/2004 | Joshi et al. | 431/9 |

(Continued)

FOREIGN PATENT DOCUMENTS

WO WO2008105653 A1 9/2008

OTHER PUBLICATIONS

Brunner, Calvin R. "Handbook of Incineration Systems", 1991, McGraw-Hill, Inc., pp. 12.1-12.5.

(Continued)

*Primary Examiner* — Gregory A Wilson
(74) *Attorney, Agent, or Firm* — Thompson Hine LLP

(57) ABSTRACT

A NOx suppression apparatus is configured for use with a burner that injects fuel into a stream of process air flowing into and through a rotary kiln. The apparatus comprises a premix injection system that forms a premix of fuel gas and air, and injects the premix into the stream of process air upstream of the burner port. This enables premix products of combustion to suppress the production of NOx by vitiating a combustion air portion of the process air before the combustion air portion combusts with fuel injected from the burner port.

18 Claims, 14 Drawing Sheets

(56) References Cited

U.S. PATENT DOCUMENTS

| | | | | |
|---|---|---|---|---|
| 7,402,038 | B2 | 7/2008 | Neville et al. | |
| 7,438,005 | B2 * | 10/2008 | Kobayashi et al. | 110/345 |
| 2002/0152770 | A1 | 10/2002 | Becher et al. | |
| 2007/0062197 | A1 * | 3/2007 | Hannum et al. | 60/737 |

OTHER PUBLICATIONS

PCT/US2010/028230, "NOx Suppression Techniques for a Rotary Kiln", Notification of Transmittal of the International Search Report and The Written Opinion of the International Searching Authority, Commissioner of U.S. Patents, dated May 19, 2010, 7 pages.

* cited by examiner

NOX SUPPRESSION TECHNIQUES FOR A ROTARY KILN

RELATED APPLICATIONS

This application claims the benefit of provisional U.S. patent application 61/180,235, filed May 21, 2009, and provisional U.S. patent application 61/162,853, filed Mar. 24, 2009, both of which are incorporated by reference.

TECHNICAL FIELD

This technology relates to a heating system in which combustion produces oxides of nitrogen (NOx), and specifically relates to the suppression of NOx in a furnace for iron ore pelletizing, lime calcining or other high temperature calcining processes, high temperature ceramic processes, and the like.

BACKGROUND

Certain industrial processes, such as heating a load in a furnace, rely on heat produced by the combustion of fuel and oxidant. Fuels include oil, natural gas, pulverized coal, and biomass. Oxidants include atmospheric air, vitiated air, oxygen, or air enriched with oxygen. Combustion of the fuel and oxidant causes NOx to result from the combination of oxygen and nitrogen.

An indurating furnace is a particular type of furnace that is known to produce high levels of NOx. Large quantities of pelletized material, such as pellets of iron ore, are advanced through an indurating process in which they are dried, heated to an elevated temperature, and then cooled. The elevated temperature induces an oxidizing reaction that hardens the material. When cooled, the indurated pellets are better able to withstand subsequent handling in storage and transportation.

The indurating furnace has sequential stations for the drying, heating, and cooling steps. In a straight grate furnace, a moving grate conveys the pelletized material into the furnace, through the sequential stations, and outward from the furnace. Air shafts known as downcorners deliver downdrafts of preheated air to the heating stations. Burners inject fuel and combustion air into the downdrafts, and the resulting combustion provides heat for the oxidation reaction that hardens the pelletized material.

Another type of indurating furnace is known as a grate-kiln furnace. It differs from a straight grate furnace by using a moving grate only for the drying and preheating steps. When those steps are completed, the pelletized material is transferred from the grate into a rotary kiln. A burner is fired into the rotary kiln to provide heat as needed to harden the pelletized material In some cases, the burner for a rotary kiln is fueled with natural gas or oil. In other cases, the burner uses solid fuel such as pulverized coal or biomass. The solid fuel is delivered to the burner in a stream of conveyance air. Additional air may be delivered to the burner for cooling. Solid fuel may also be mixed with the pelletized material. A hood structure provides the rotary kiln with process air that is separate from the conveyance/cooling air at the burner. The process air includes combustion air needed for combustion of the fuel, and also includes air needed for the oxidation reaction in the pelletized material.

SUMMARY

The invention provides an apparatus for use with a burner that injects fuel into a stream of process air flowing into and through a rotary kiln. The apparatus comprises a premix injection system configured to form a premix of fuel gas and air, and to inject the premix into the stream of process air upstream of the burner port. This enables premix products of combustion (POC's) to suppress the production of NOx by vitiating a combustion air portion of the process air before the combustion air portion combusts with fuel injected from the burner port.

In a particular embodiment of the invention, the premix is injected into the stream of process air beside the burner port rather than upstream of the burner port. This arrangement may be helpful for retrofitted applications of the invention where space is limited in the hood structure that conveys the process air to the rotary kiln. Another particular embodiment has an arcuate premix injector port. This enables the injected premix to suppress the production of NOx by forming an arcuate region of vitiation through which a combustion air portion of the process air can flow before combusting with fuel injected from the burner port. The arcuate port preferably extends fully around the burner port to form a tubular region of vitiation.

Summarized differently, the invention applies to a combustion zone in a rotary kiln. A burner injects fuel into the combustion zone. A hood structure directs process air into the combustion zone separately from the burner. In accordance with the invention, a premix of fuel gas and combustion air is injected into the combustion zone separately from the fuel injected from the burner and the process air provided from the hood.

The invention reduces the production of NOx by replacing part of the burner fuel with premix fuel. This is especially effective if the burner uses solid fuel and the premix is a lean mixture of natural gas and combustion air. The premix POC's also help to suppress the production of NOx by vitiating some of the process air that flows from the hood into and through the combustion zone. For this reason the premix is preferably injected at locations from which the premix POC's will vitiate only the process air that participates, or is most likely to participate, in the combustion reaction.

Each embodiment of the invention is arranged to interpose premix POC's between the burner fuel and the process air flowing into the combustion zone. The premix POC's vitiate a portion of the process air that serves as combustion air by mixing with that portion of the process air before it forms a combustible mixture with the burner fuel. The premix POC's may be interposed as one or more layers or differently shaped regions that the combustion air must penetrate to form a combustible mixture with the burner fuel. Examples include one or more fan-shaped layers or blankets of premix POC beside the burner fuel stream, a group of premix POC streams arranged in a circle surrounding the burner fuel stream, and a single premix POC stream with an annular shape surrounding the burner fuel stream. Preferably, a controller operates valves in a reactant supply and control system such that the injected premix has a lean fuel-to-oxidant ratio.

The premix injector structure may be of either new or retrofitted construction as needed for any particular implementation of the invention. Retrofitted implementations preferably minimized the modifications to the existing structure.

DESCRIPTION OF ILLUSTRATED EMBODIMENTS

Figure 1:
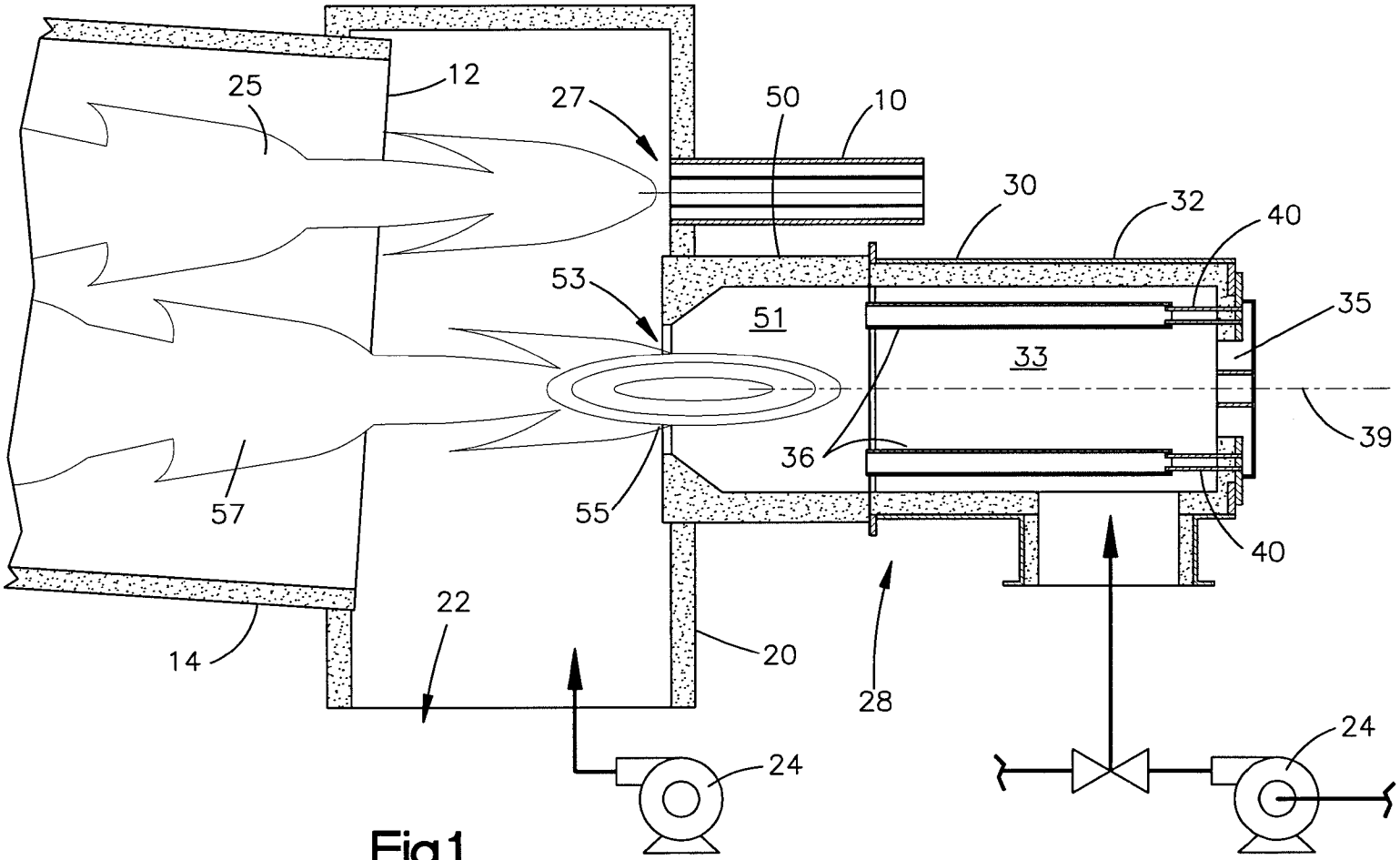
FIG. 1 is partial side view of a grate kiln furnace having parts configured as an embodiment of the invention.

As shown in FIG. 1, a burner 10 in a grate-kiln furnace injects a fuel stream into the outlet end 12 of a rotary kiln 14. The fuel stream may consist of liquid or gaseous fuel, such as oil or natural gas, and may alternatively include solid fuel. The solid fuel may be delivered to the burner 10 in a stream of conveyance air. A hood 20 has an opening 22 through which pelletized material drops from the kiln 14. A blower system 24 delivers a pressurized flow of process air to the hood 20 through the opening 22. The process air is preferably preheated by passing it through a bed of pelletized material in the cooling portion of the indurating process. The process air includes the air needed for the reaction that hardens the pelletized material in the rotary kiln 14, and also includes the combustion air needed for combustion of the burner fuel. Some of the process air thus forms a combustible mixture with the burner fuel. This results in combustion indicated by the flame 25 projecting from the burner port 27 into the kiln 14.

Also shown in FIG. 1 is a premix injection system 28. This particular example of a premix injection system 28 includes a premix burner 30. The premix burner 30 has a rear portion 32 defining an oxidant plenum 33 and fuel plenum 35. The oxidant plenum 33 receives air from the blower system 24. The air delivered to the oxidant plenum 33 typically is unheated atmospheric air, but could include preheated air circulated from a cooling station or elsewhere in the furnace. The fuel plenum 35 receives a stream of fuel gas, which is preferably taken from the plant supply of natural gas.

Mixer tubes 36 are located within the oxidant plenum 33. The mixer tubes 36 in this example are arranged in a circular array centered on a longitudinal axis 39. Each mixer tube 36 has an open inner end that receives a stream of combustion air directly from within the oxidant plenum 33. Each mixer tube 36 also receives streams of fuel from conduits 40 that extend from the fuel plenum 35 into the mixer tube 36. As these streams of fuel and combustion air flow through the mixer tubes 36, they mix together to form a combustible mixture known as premix.

An outer portion 50 of the premix burner 30 defines a reaction zone 51 with an outlet port 53. The premix is ignited in the reaction zone 51 upon emerging from the open outer ends of the mixer tubes 36. Ignition is initially accomplished by use of an igniter before the reaction zone 51 reaches the auto-ignition temperature of the premix. Combustion proceeds as the premix is injected from the outlet port 53 into the hood 20 and the rotary kiln 14. This is indicated by the schematic illustration of a stable premix flame 55 projecting from the reaction zone 51 through the outlet port 53. The premix is thus injected into the combustion zone such that the premix POC are interposed between the burner flame 25 and the combustion air flowing to the burner flame 25 from the hood opening 22.

Figure 2:
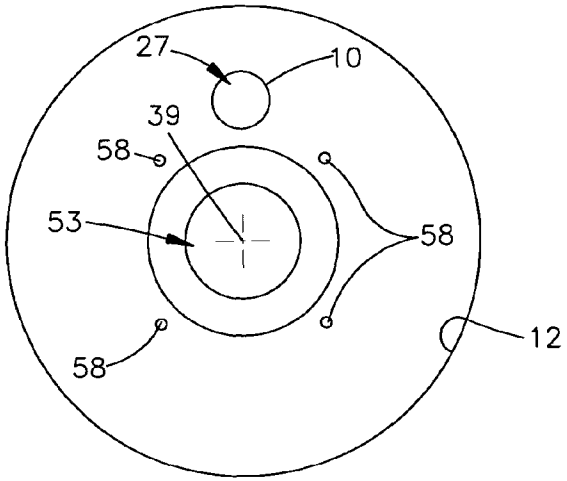
FIG. 2 is a front view of parts shown in FIG. 1.

FIG. 2 is a partial front end view that shows the furnace burner 10 and the premix burner 30 within a projected view of the kiln opening 12. The front end view shows an optional staged fuel injection system comprising a circular array of secondary fuel injectors 58. Also shown in the side view of FIG. 1 is a secondary flame 57 projecting forward from the stable premix flame 55 through the hood 20 and into the rotary kiln 14. The secondary flame 57 results from combustion of secondary fuel injected from the secondary fuel injectors 58. The production of NOx is further suppressed by staging the fuel in this arrangement.

Figure 3:
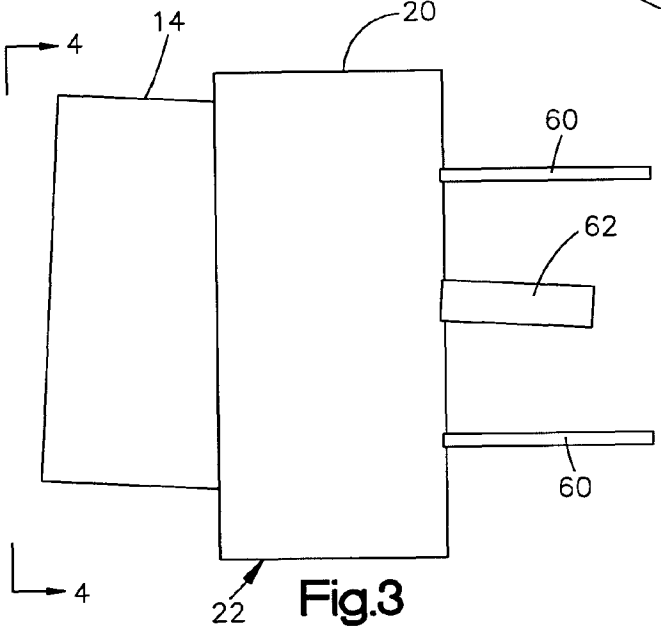
FIG. 3 is a side view showing another embodiment of the invention.

FIG. 3 is a schematic side view similar to FIG. 1, but differs from FIG. 1 by showing premix injectors 60 instead of a premix burner. Unlike the premix burner 30 of FIG. 1, the premix injectors 60 do not have structures for stabilizing a flame. The premix injectors 60 in this example are arranged in a circular array centered on the furnace burner 62, and are thus arranged to interpose a corresponding array of premix POC streams between the burner flame and the combustion air flowing through the hood.

Figure 6:
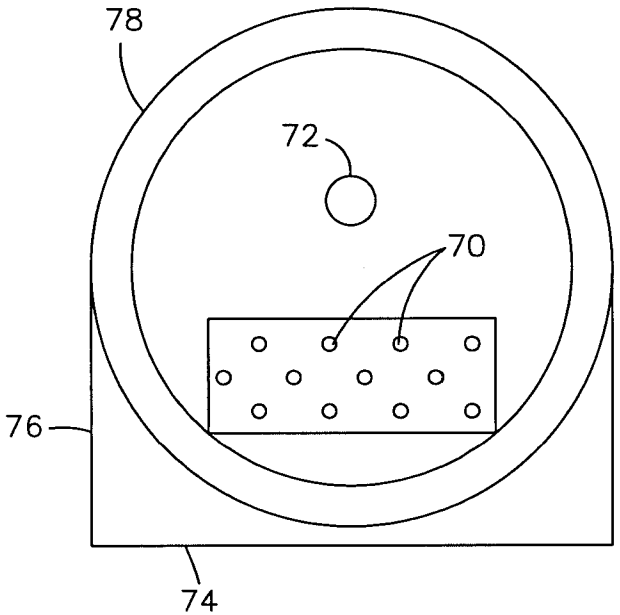
FIG. 6 is a front view taken on line 6-6 of FIG. 5.
Figure 5:
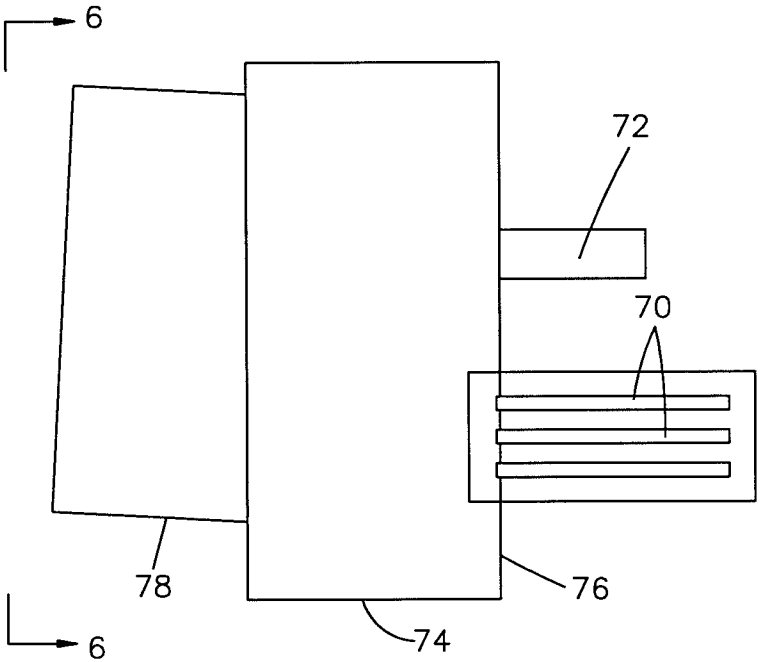
FIG. 5 is a side view showing another embodiment of the invention.
Figure 7:
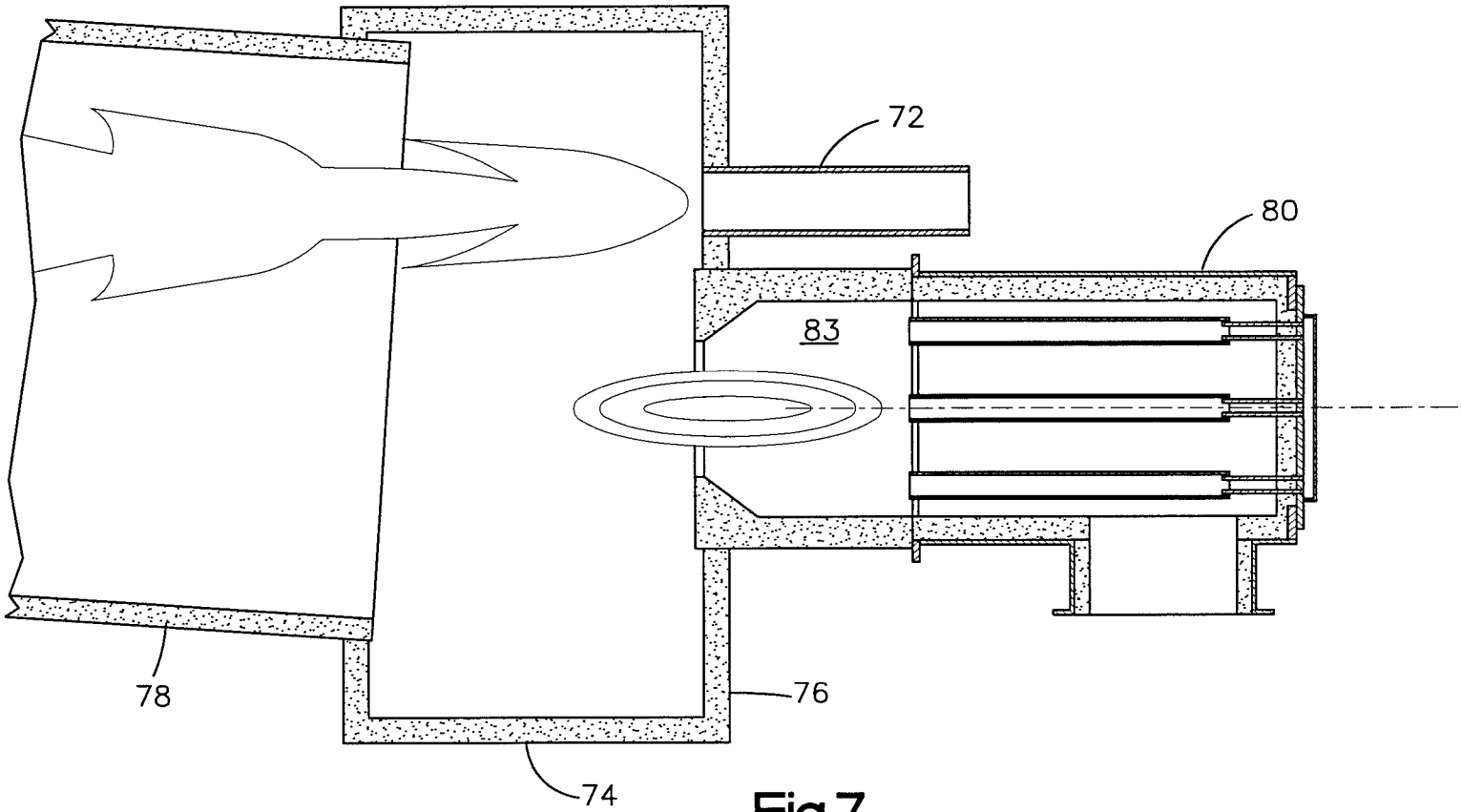
FIG. 7 is a side view showing another embodiment of the invention.

FIGS. 5 and 6 schematically illustrate premix injectors 70 in a generally rectangular array between a furnace burner 72 and the open lower end 74 of a hood 76 through which combustion air flows toward and into a rotary kiln 78. The injected streams of premix form a layer or blanket of premix POC's through which the combustion air must flow to meet and form a combustible mixture with a fuel stream injected from the burner 72. A variation of this embodiment employs a premix burner 80 with a rectangular array of mixer tubes 82, as shown in FIG. 7. The configuration of the premix burner 80 at the reaction zone 83 adds flame stabilization to the injected premix.

Figure 8:
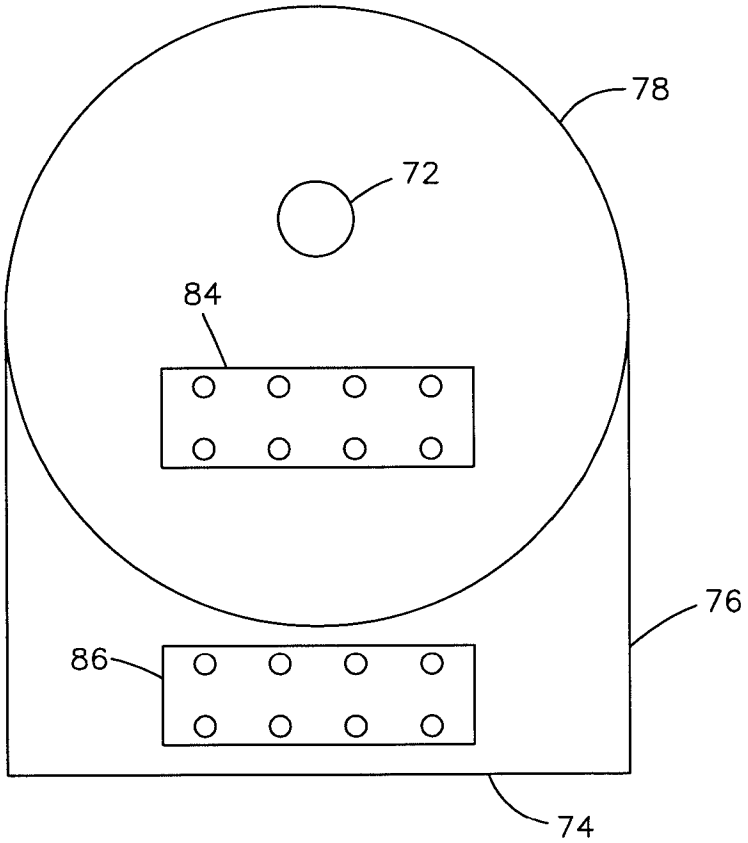
FIG. 8 is front view showing another embodiment of the invention.
Figure 9:
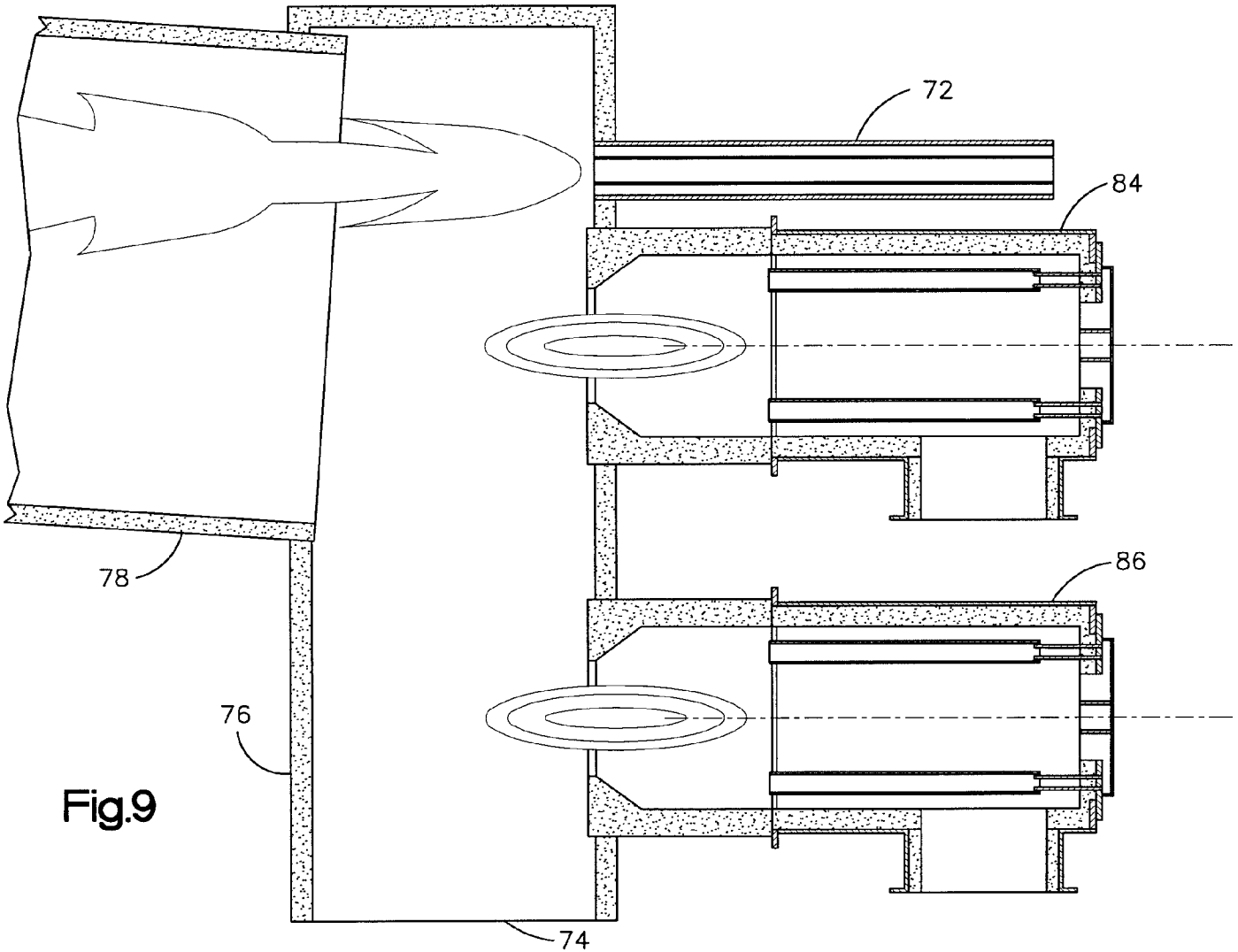
FIG. 9 is a side view showing another embodiment of the invention.
Figure 10:
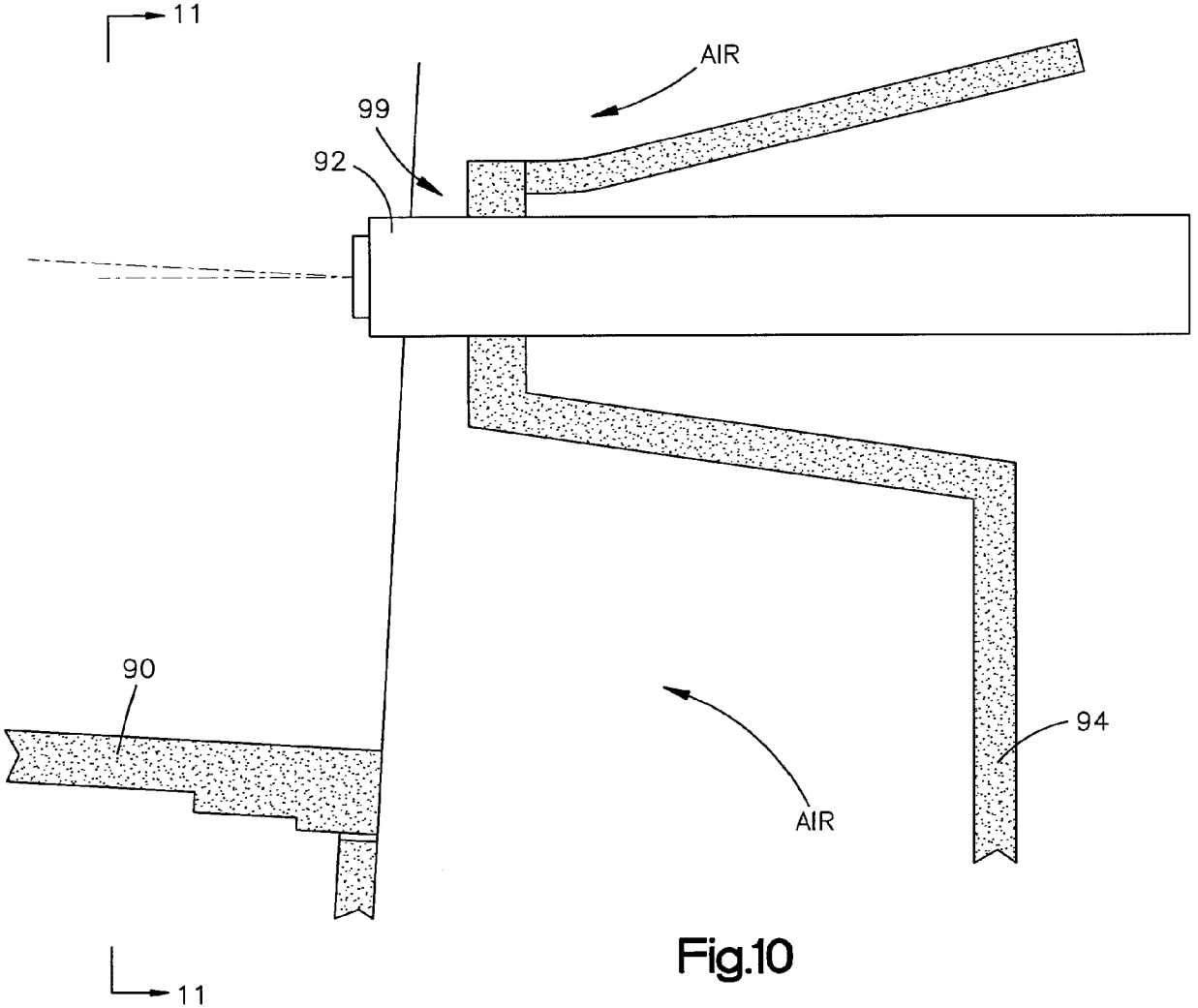
FIG. 10 side view showing another embodiment of the invention.
Figure 12:
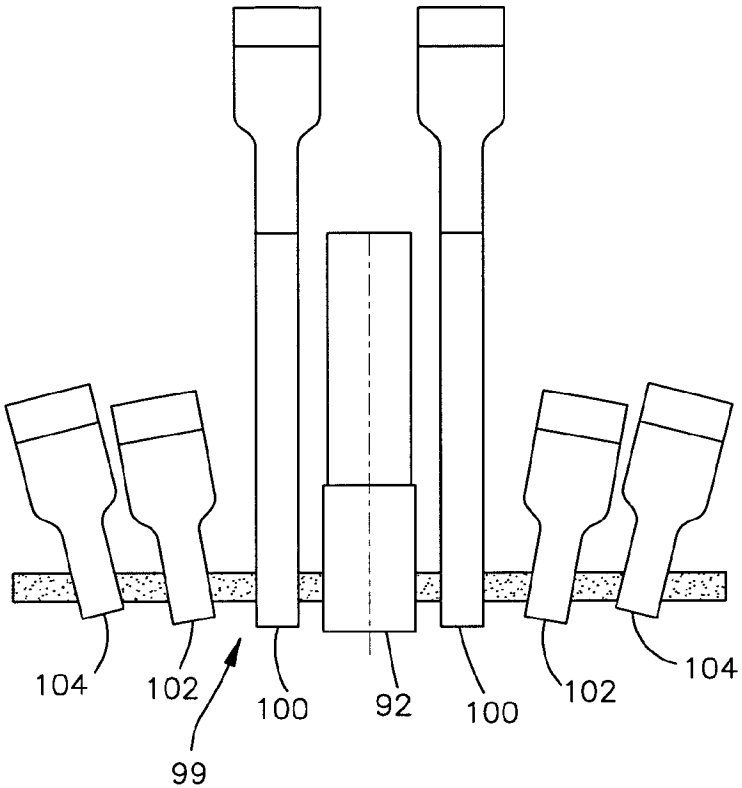
FIG. 12 is a top view taken on line 12-12 of FIG. 11.
Figure 11:
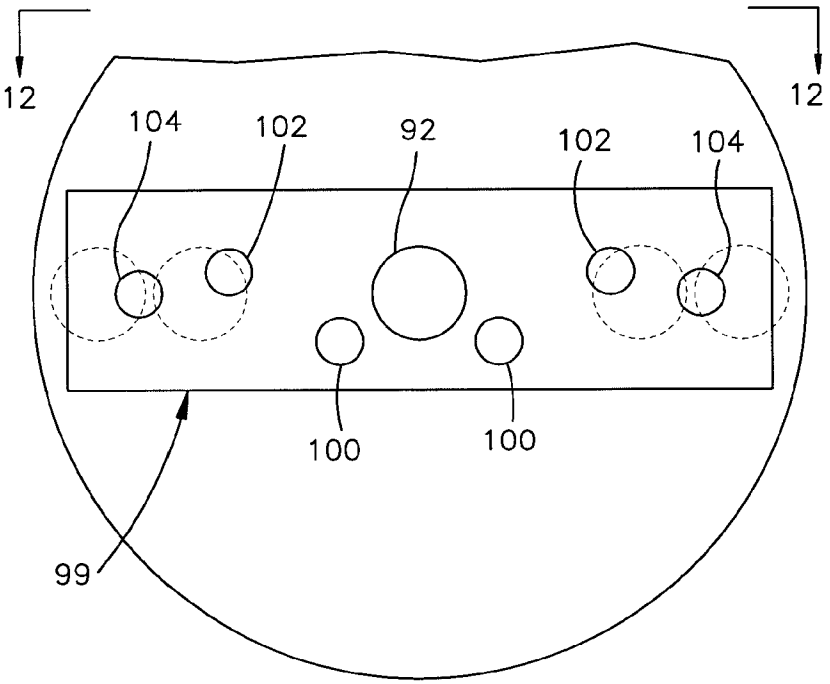
FIG. 11 is a front view taken on line 11-11 of FIG. 10.
Figure 13:
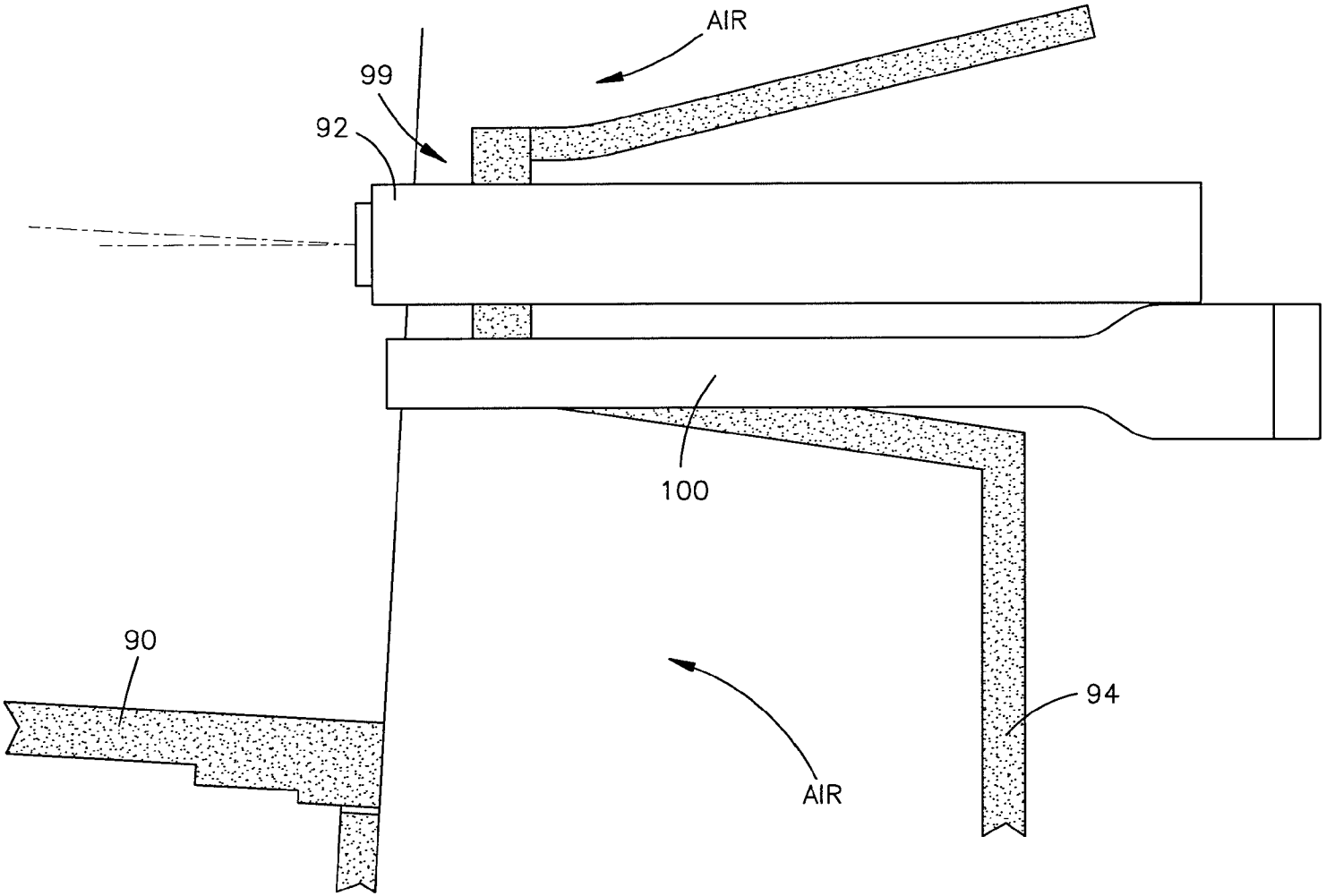
FIGS. 13-15 are side views of parts shown in FIGS. 11 and 12.
Figure 14:
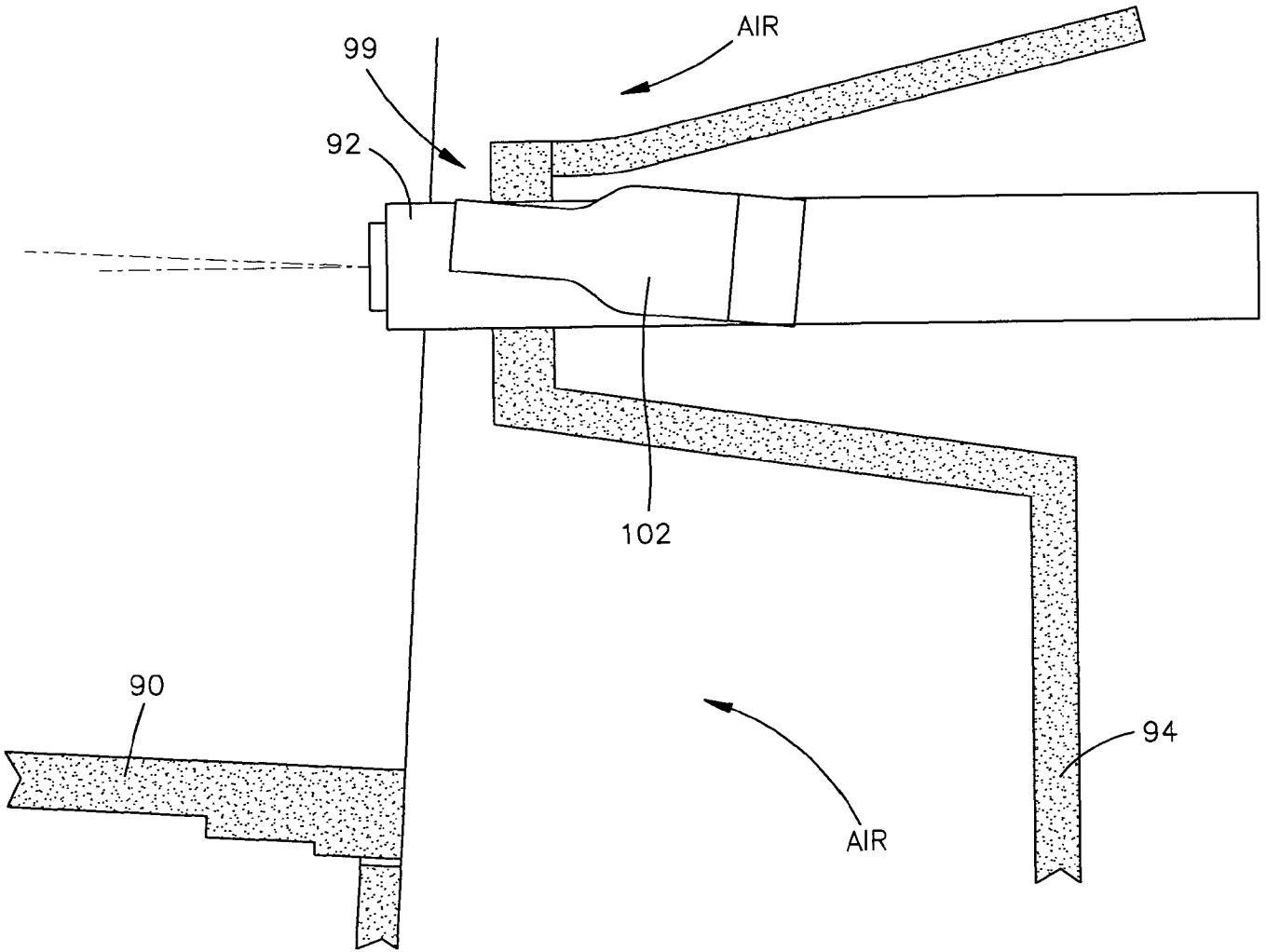

FIGS. 8 and 9 are similar to FIGS. 6 and 7, respectively, and show additional premix injection structures 84 and 86.

FIGS. 10-15 are schematic views of a grate-kiln furnace that is retrofitted in accordance with the invention. The furnace has a rotary kiln 90, a burner 92, and a hood 94 that delivers process air to the rotary kiln 90. The hood 94 is configured to deliver flows of process air from above and below the burner 92. As shown in the drawing, this configuration of the hood 94 provides only a narrow space for the burner 92. This confined space is best indicated schematically by the rectangle 99 shown in the front view of FIG. 11.

As shown throughout FIGS. 11-15, three pairs of premix injection tubes 100, 102, and 104 are arranged within the rectangular space 99. In each case, the premix injector tubes are oriented to inject premix into the process air so that the premix POC's will most effectively vitiate the combustion air portions of the process air both above and below the burner 92. For example, the first pair of tubes 100 are located beneath the burner 92, or at least partially beneath the burner 92, so that the corresponding premix POC's will be interposed between the burner fuel stream and the process air flowing upward from beneath the burner 92. The limited space 99 in this particular retrofitting environment does not allow for placement of premix injector tubes above the burner 92. Therefore, the second and third pairs of tubes 102 and 104 are located beside the burner 92, but are skewed upward to have the same vitiating effect on the air flowing downward from above the burner 92.

Figure 4:
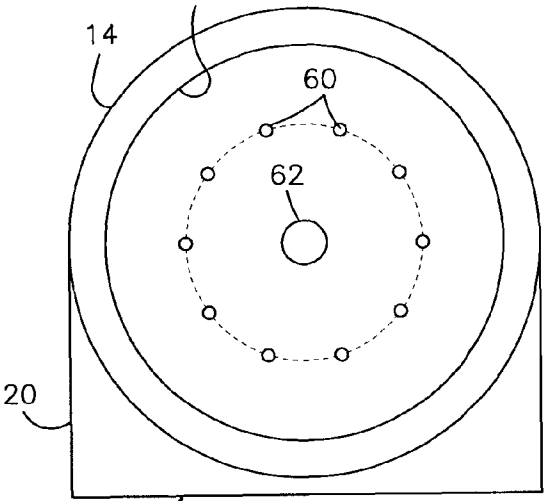
FIG. 4 is a front view taken on line 4-4 of FIG. 3.
Figure 15:
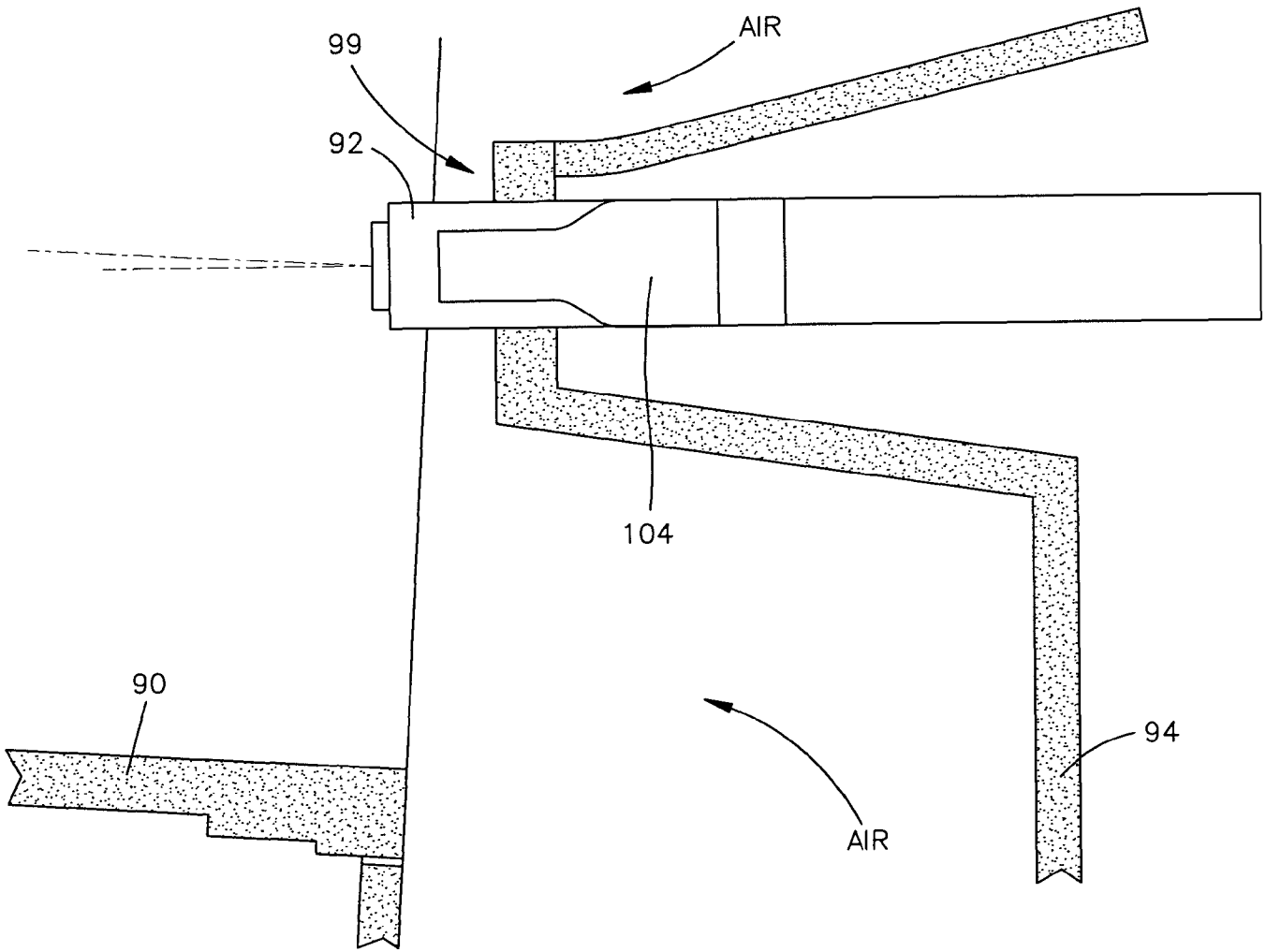
Figure 16:
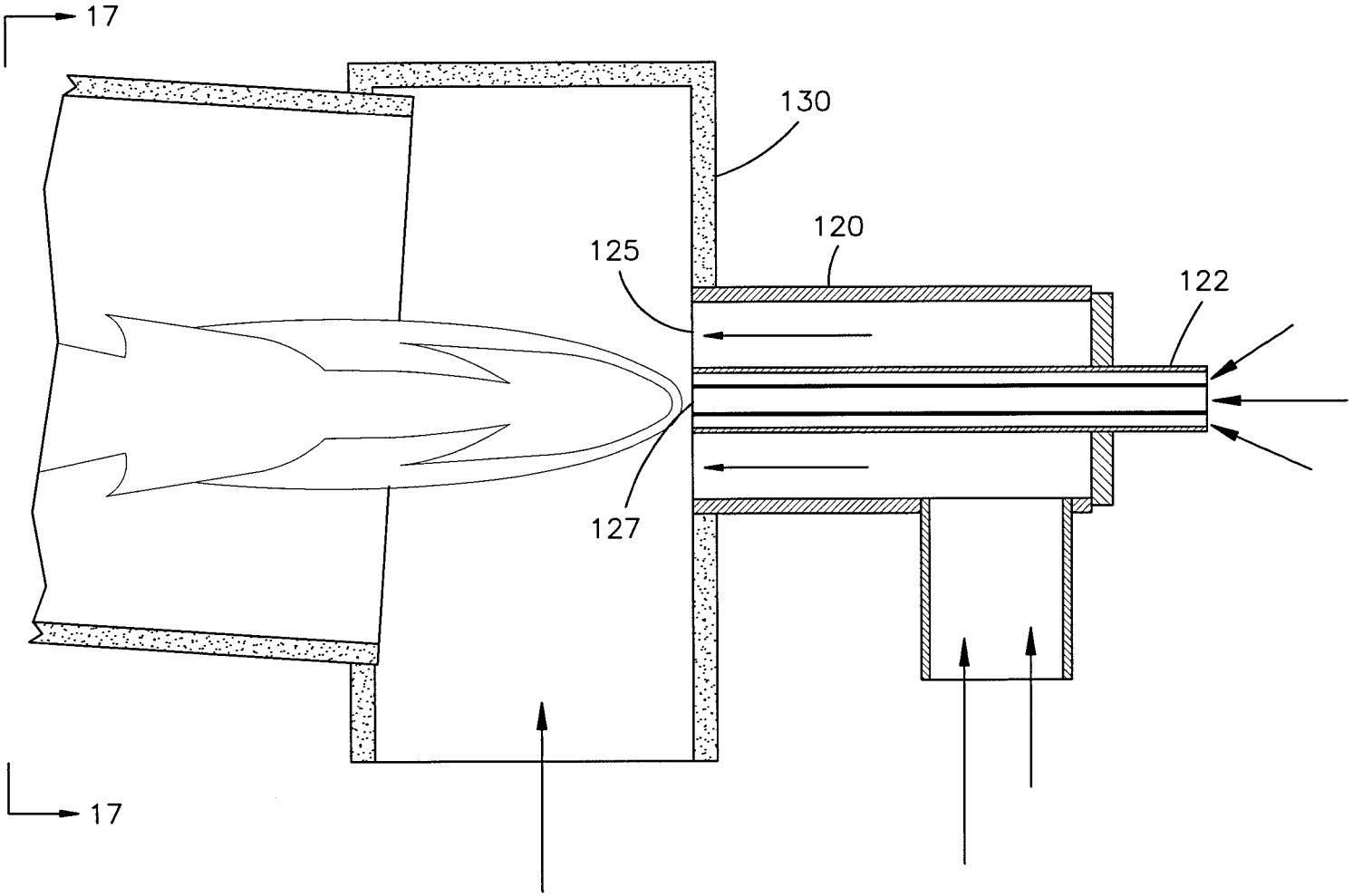
FIG. 16 is side view showing another embodiment of the invention.
Figure 17:
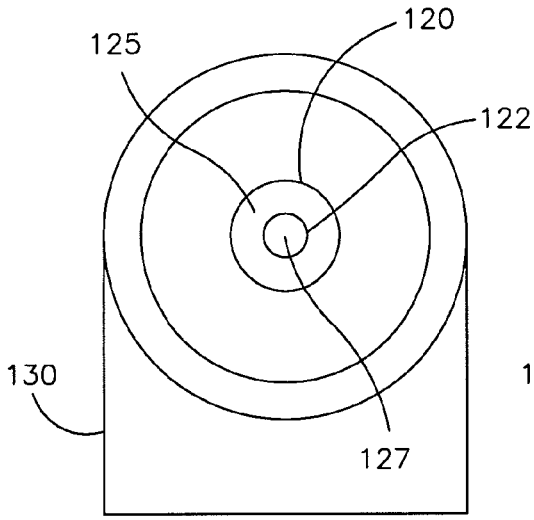
FIG. 17 is a front view taken on line 17-17 of FIG. 16.

FIGS. 16 and 17 show a premix injector apparatus 120 configured to inject a stream of premix in an annular shape surrounding a fuel stream injected from the furnace burner 122. Specifically, this premix injector apparatus 120 has an outlet port 125 in the form of an annulus that fully surrounds the circular outlet port 127 of the burner 122. The annular outlet port 125 is spaced radially from the circular outlet port 127 by only the radial thickness of the burner tube that defines the circular outlet port 127. The stream of premix emerging from the annular outlet port 125 forms a tubular wall of premix POC's that is interposed radially between the burner fuel stream and the process/combustion air that flows through the hood 130. This vitiates the process/combustion air that must pass through the premix POC's before it can form a combustible mixture with the furnace fuel stream. Unlike the arrangement of FIGS. 3 and 4, which provides a circular array of premix POC streams that are at least partially spaced apart from each other circumferentially, the arrangement of FIGS. 15 and 16 provides a continuous 360 degree region of vitiation.

Figure 18:
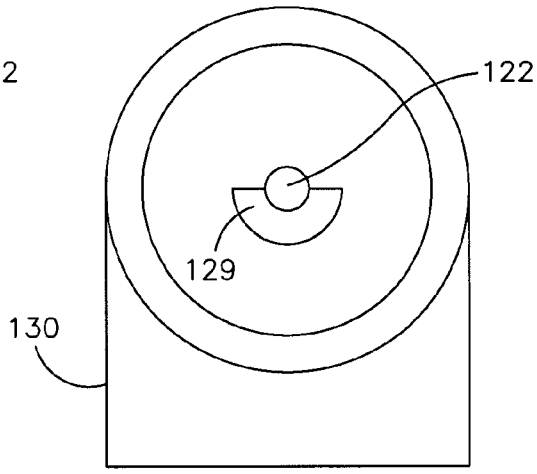
FIG. 18 is front view showing another embodiment of the invention.

A variation of the FIG. 15-16 embodiment could have an arcuate premix outlet port that extends continuously but only partially around the burner outlet port. The semi-circular premix outlet port 129 of FIG. 18 is an example of this variation. Other examples might extend 90 degrees, 120 degrees, or combinations of these and other lengths. Such an arcuate outlet port could be employed in combination with one or more discrete premix injectors like those described above. Injectors like those of FIG. 4 would preferably be located in a concentric arcuate array extending circumferentially between the opposite ends of the arcuate outlet port(s).

Figure 19:
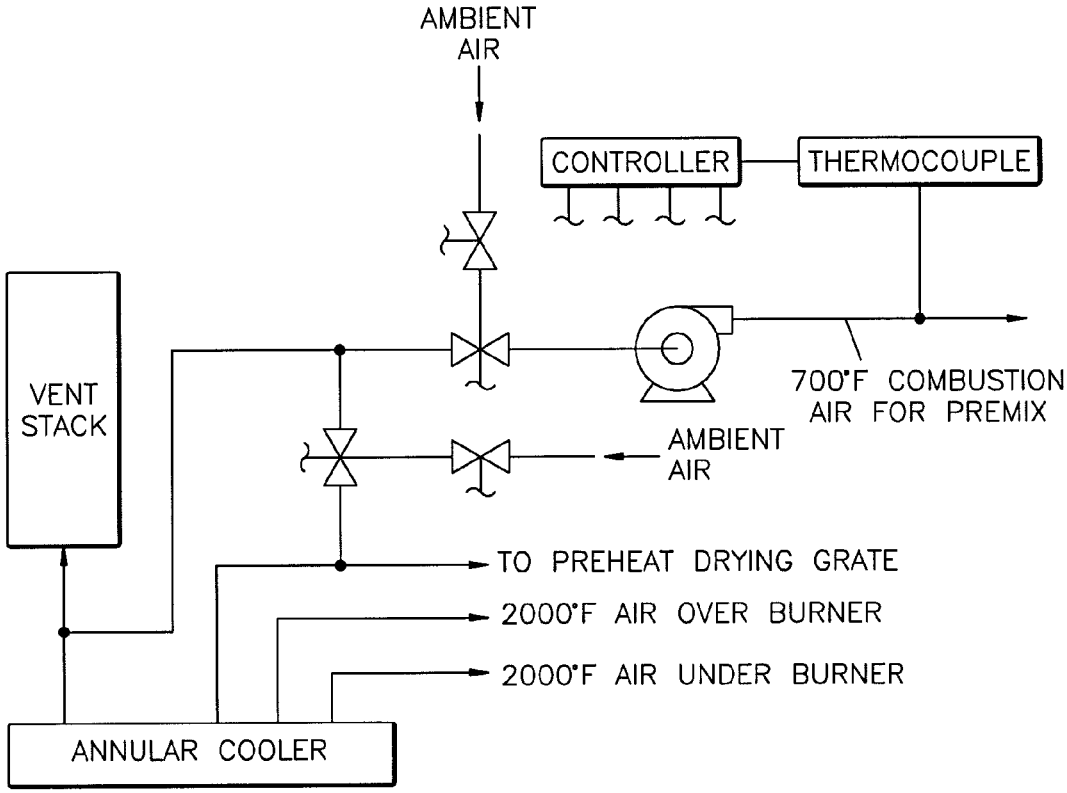
FIG. 19 is a view showing other parts of a grate kiln furnace configured according to the invention.

FIG. 19 shows that the premix air can include preheated air drawn from an annular cooler in the grate-kiln furnace.

Figure 20:
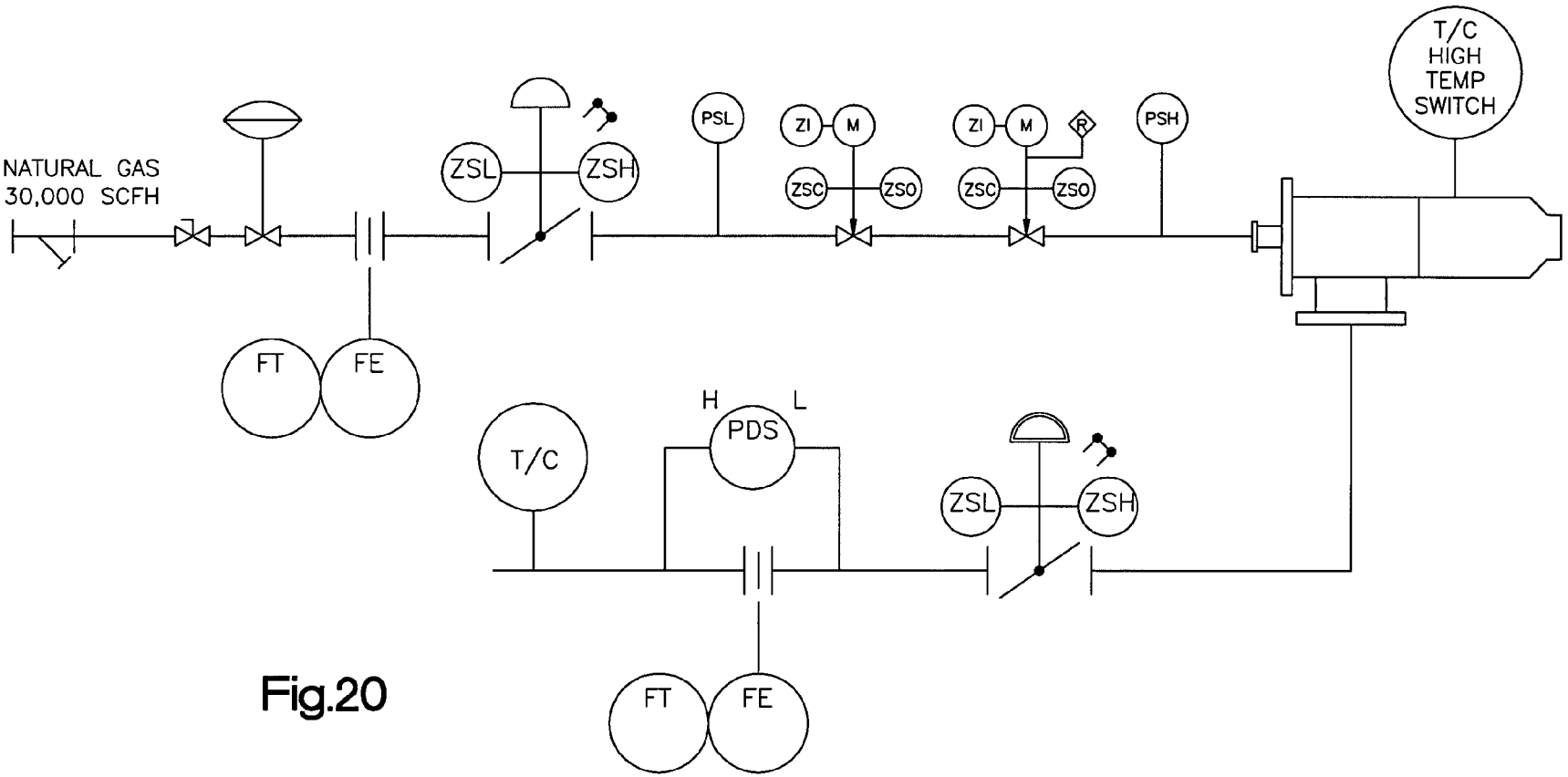
FIG. 20 also is a view showing other parts of a grate kiln furnace configured according to the invention.

FIG. 20 shows a schematic for equipment controlling the flow of the fuel and air streams into the premix assemblies described above. Automated supervisory shut-off valves are shown which may be controlled by a controller (controller not shown) that detects that the combustion chamber is above the auto-ignition temperature, so that it is safe to begin injecting the premix directly into the hot combustion chamber.

A process controller (not shown) determines when it is necessary to increase or decrease the amount of energy furnished by the premix injector, and increases or decreases a demand signal accordingly.

Both fuel and air streams are measured by flow-metering equipment as shown. In addition, a thermocouple or other measurement device determines the temperature of the combustion air. A fuel-air ratio controller which is not shown then determines the proper ratio of air to fuel, based on the demand signal from the process-controller, and the temperature of the combustion air. The flow-control valves in the air and fuel lines can then be modulated to the values determined by the process controller and the fuel-air ratio controller.

A thermocouple or other temperature sensing device can be installed in the mixer body and monitored, so that fuel flow may be interrupted if a temperature above a safe value is measured.

This written description sets forth the best mode of the invention, and describes the invention so as to enable a person of ordinary skill in the art to make and use the invention, by presenting examples of the elements recited in the claims. The patentable scope of the invention is defined by the claims, and may include other examples that occur to those skilled in the art. Such other examples are intended to be within the scope of the claims if they have elements that do not differ from the literal language of the claims, or if they have equivalent elements with insubstantial differences from the literal language of the claims.

The invention claimed is:

1. An apparatus comprising:

a rotary kiln with an outlet end;

a hood having an opening to receive a flow of process air, the hood being configured to convey the flow of process air from the opening to the outlet end of the rotary kiln;

a burner having a port for injecting fuel into the flow of process air downstream of the hood opening; and a premix injection system configured to form a premix of fuel gas and air, and to inject the premix into the flow of process air between the hood opening and the burner port, whereby the premix products of combustion can suppress the production of NOx by vitiating a combustion air portion of the process air before the combustion air portion combusts with fuel injected from the burner port.

2. An apparatus as defined in claim 1 wherein the premix injection system includes a premix burner with an outlet port configured to inject premix into the hood, and further includes mixer tubes configured to supply premix to the outlet port.

3. An apparatus as defined in claim 1 further comprising fuel injectors configured to inject staged fuel into the flow of process air between the hood opening and the burner port.

4. An apparatus as defined in claim 3 wherein the premix injection system includes a premix burner with an outlet port configured to inject premix into the hood, and further includes mixer tubes configured to supply premix to the outlet port, and the fuel injectors are arranged in a circular array surrounding the outlet port.

5. An apparatus as defined in claim 1 wherein the premix injection system includes multiple premix injectors configured to inject respective streams of premix into the flow of process air between the hood opening and the burner port.

6. An apparatus as defined in claim 5 wherein the premix injectors are arranged in a circular array surrounding the burner port.

7. An apparatus as defined in claim 5 wherein the premix injectors are arranged in a rectangular array between the hood opening and the burner port.

8. An apparatus as defined in claim 5 wherein the premix injectors are arranged in multiple rectangular arrays between the hood opening and the burner port.

9. An apparatus for use with a burner having a port for injecting fuel into a stream of process air flowing into and through a rotary kiln, the apparatus comprising:

a premix injection system configured to form a premix of fuel gas and air, and to inject the premix into the stream of process air upstream of the burner port, whereby products of premix combustion can suppress the production of NOx by vitiating a combustion air portion of the process air before the combustion air portion combusts with fuel injected from the burner port;

wherein the premix injection system includes a premix burner with an outlet port and mixer tubes configured to supply premix to the outlet port.

10. An apparatus for use with a burner having a port for injecting fuel into a stream of process air flowing into and through a rotary kiln, the apparatus comprising:

a premix injection system configured to form a premix of fuel gas and air, and to inject the premix into the stream of process air upstream of the burner port, whereby products of premix combustion can suppress the production of NOx by vitiating a combustion air portion of the process air before the combustion air portion combusts with fuel injected from the burner port; and fuel injectors configured to inject staged fuel into the stream of process air upstream of the burner port;

wherein the premix injection system includes a premix burner with an outlet port and mixer tubes configured to supply premix to the outlet port, and the fuel injectors are arranged in a circular array surrounding the outlet port.

11. An apparatus comprising:

a rotary kiln having an inlet end configured to receive material to be processed at an elevated temperature and an outlet end configured to discharge processed material;

a burner having a port for injecting fuel;

a blower system configured to drive a stream of process air through the kiln to provide air for processing material in the kiln, and to provide combustion air for fuel injected from the burner; and a premix injection system configured to form a premix of fuel gas and air, and to inject the premix into the stream of process air upstream of the burner port, whereby products of premix combustion can suppress the production of NOx by vitiating a combustion air portion of the process air before the combustion air portion combusts with fuel injected from the burner port.

12. An apparatus as defined in claim 11 further comprising fuel injectors configured to inject staged fuel into the stream of process air upstream of the burner port.

13. An apparatus as defined in claim 11 wherein the premix injection system includes multiple premix injectors configured to inject respective streams of premix into the stream of process air upstream of the burner port.

14. An apparatus as defined in claim 13 wherein the premix injectors are arranged in a circular array surrounding the burner port.

15. An apparatus as defined in claim 13 wherein the premix injectors are arranged in a rectangular array upstream of the burner port.

16. An apparatus as defined in claim 13 wherein the premix injectors are arranged in multiple rectangular arrays upstream of the burner port.

17. An apparatus comprising:

a rotary kiln having an inlet end configured to receive material to be processed at an elevated temperature and an outlet end configured to discharge processed material;

a burner having a port for injecting fuel into the rotary kiln;

a blower system configured to drive a stream of process air through the rotary kiln to provide air for processing material in the rotary kiln, and to provide combustion air for fuel injected from the burner; and a premix injection system configured to form a premix of fuel gas and air, and to inject the premix into the stream of process air beside the burner port, whereby products of premix combustion can suppress the production of NOx by vitiating a combustion air portion of the process air before the combustion air portion combusts with fuel injected from the burner port.

18. An apparatus as defined in claim 17 wherein the premix injection system includes multiple premix injectors configured to inject respective streams of premix into the stream of process air beside the burner port, including injectors that are skewed relative to the burner port.

* * * * *